US008959852B2

(12) United States Patent
Prince et al.

(10) Patent No.: US 8,959,852 B2
(45) Date of Patent: Feb. 24, 2015

(54) METHODS AND SYSTEMS OF INTERIOR WINDOW FRAMING

(71) Applicants: Kendall W. Prince, Layton, UT (US); Jack R. Prince, West Bountiful, UT (US); Matt A. Stott, Syracuse, UT (US)

(72) Inventors: Kendall W. Prince, Layton, UT (US); Jack R. Prince, West Bountiful, UT (US); Matt A. Stott, Syracuse, UT (US)

(73) Assignee: Outlook Window Products, L.L.C., Layton, UT (US)

( * ) Notice: Subject to any disclaimer, the term of this patent is extended or adjusted under 35 U.S.C. 154(b) by 0 days.

(21) Appl. No.: 13/908,891

(22) Filed: Jun. 3, 2013

(65) Prior Publication Data

US 2014/0013682 A1 Jan. 16, 2014

Related U.S. Application Data

(63) Continuation of application No. 13/245,365, filed on Sep. 26, 2011, now Pat. No. 8,453,397, which is a continuation of application No. 11/138,225, filed on May 26, 2005, now Pat. No. 8,024,899.

(60) Provisional application No. 60/574,755, filed on May 26, 2004.

(51) Int. Cl.

| | |
|---|---|
| ***E04B 1/04*** | (2006.01) |
| ***E06B 1/08*** | (2006.01) |
| ***E06B 1/04*** | (2006.01) |
| *E06B 1/10* | (2006.01) |

(52) U.S. Cl.

CPC ... *E06B 1/04* (2013.01); *E06B 1/10* (2013.01); *E06B 1/08* (2013.01)

USPC ..... 52/211; 52/204.53; 52/208; 52/213; 52/656.9; 52/718.01

(58) Field of Classification Search

CPC ..... E06B 1/04; E06B 1/045; E06B 1/10; E06B 1/342; E06B 1/345; E06B 1/36; D06B 1/20; D06B 1/34; E04F 19/02

USPC ..... 52/204.1, 204.53, 204.54, 208, 211, 52/212, 213, 217, 656.9, 718.01–718.07, 52/745.15

See application file for complete search history.

(56) References Cited

U.S. PATENT DOCUMENTS

| | | | |
|---|---|---|---|
| 1,202,990 | A | 10/1916 | Gill |
| 1,263,248 | A | 4/1918 | Hope |
| 1,913,313 | A | 6/1933 | Browne |
| 1,947,736 | A | 2/1934 | Potter |
| 2,426,567 | A | 8/1947 | Snider |
| 2,576,539 | A | 11/1951 | Rundquist |
| 2,578,470 | A | 12/1951 | Gorell et al. |

(Continued)

FOREIGN PATENT DOCUMENTS

| | | |
|---|---|---|
| CN | 2498284 | 7/2002 |
| WO | WO 2005/118997 A1 | 12/2005 |
| WO | WO 2007/059159 A1 | 5/2007 |

OTHER PUBLICATIONS

Brochure: "Mason Ultragard Protection P.V.C. Protection, Casement Windows," Mason Windows Limited, 1987.

*Primary Examiner* — William Gilbert

(74) *Attorney, Agent, or Firm* — David B. Tingey; Bryant J. Keller; Kirton McConkie

(57) ABSTRACT

An interior window framing system comprising a standardized frame having predetermined dimensions proportionate to a standard window.

20 Claims, 12 Drawing Sheets

(56) References Cited

U.S. PATENT DOCUMENTS

| | | | | | |
|---|---|---|---|---|---|
| 2,845,665 | A | | 8/1958 | Place | |
| 2,912,078 | A | | 11/1959 | Kiehl et al. | |
| 2,983,001 | A | | 5/1961 | Guldager | |
| 3,075,235 | A | | 1/1963 | Albinson | |
| 3,183,547 | A | | 5/1965 | Bury | |
| 3,245,124 | A | | 4/1966 | Faske | |
| 3,358,402 | A | | 12/1967 | Sahm | |
| 3,878,644 | A | | 4/1975 | Brown et al. | |
| 3,927,492 | A | | 12/1975 | Carson | |
| 4,014,146 | A | | 3/1977 | DiMascio et al. | |
| 4,160,343 | A | | 7/1979 | Hubbard | |
| 4,175,357 | A | | 11/1979 | Goldhaber | |
| 4,196,545 | A | | 4/1980 | Korany et al. | |
| 4,226,066 | A | | 10/1980 | Persson | |
| 4,266,387 | A | | 5/1981 | Karlsson | |
| 4,328,650 | A | | 5/1982 | Garbell | |
| 4,339,901 | A | | 7/1982 | Hubbard | |
| 4,407,100 | A | | 10/1983 | Huelsekopf | |
| 4,430,831 | A | | 2/1984 | Kemp | |
| 4,599,836 | A | | 7/1986 | Melcher | |
| 4,663,885 | A | | 5/1987 | Stibolt | |
| 4,811,533 | A | | 3/1989 | Wetsel | |
| 4,875,318 | A | | 10/1989 | MacLeod et al. | |
| 4,886,103 | A | | 12/1989 | Baier | |
| 4,891,921 | A | | 1/1990 | Governale | |
| 4,974,366 | A | | 12/1990 | Tizzoni | |
| 4,982,530 | A | * | 1/1991 | Palmer | 49/504 |
| 5,148,649 | A | | 9/1992 | Cipriano | |
| 5,230,738 | A | | 7/1993 | Wheeler | |
| 5,317,853 | A | | 6/1994 | Lopes | |
| 5,351,452 | A | | 10/1994 | Gates | |
| 5,390,454 | A | | 2/1995 | Coddens | |
| 5,419,085 | A | | 5/1995 | Imbur | |
| 5,423,149 | A | * | 6/1995 | Herbst | 49/382 |
| 5,437,130 | A | * | 8/1995 | Raynak | 52/210 |
| 5,490,353 | A | * | 2/1996 | McLaughlin | 49/64 |
| 5,599,051 | A | * | 2/1997 | Bourgeois | 292/262 |
| 5,623,783 | A | * | 4/1997 | Kenkel | 49/21 |
| 5,653,074 | A | * | 8/1997 | Yoon | 52/210 |
| 5,797,223 | A | * | 8/1998 | Shoup et al. | 52/204.1 |
| 5,809,617 | A | * | 9/1998 | Harris et al. | 16/273 |
| 5,857,298 | A | * | 1/1999 | Fullwood | 52/202 |
| 5,865,652 | A | * | 2/1999 | Stuter et al. | 439/680 |
| 5,893,600 | A | * | 4/1999 | McManus | 296/146.16 |
| 5,901,511 | A | * | 5/1999 | Yoshida | 52/212 |
| 5,913,786 | A | * | 6/1999 | Mayer | 52/204.7 |
| 6,141,922 | A | * | 11/2000 | Carlisle et al. | 52/204.1 |
| 6,148,584 | A | * | 11/2000 | Wilson | 52/717.01 |
| 6,192,638 | B1 | * | 2/2001 | Wang | 52/213 |
| 6,212,835 | B1 | * | 4/2001 | Schiedegger et al. | 52/211 |
| 6,223,484 | B1 | * | 5/2001 | Minter | 52/213 |
| 6,253,507 | B1 | * | 7/2001 | Martino | 52/211 |
| 6,257,301 | B1 | * | 7/2001 | Conforti | 160/84.07 |
| 6,276,101 | B1 | * | 8/2001 | Schiedegger et al. | 52/211 |
| 6,343,448 | B1 | * | 2/2002 | Lin | 52/204.1 |
| 6,385,927 | B2 | * | 5/2002 | Schiedegger et al. | 52/211 |
| 6,389,763 | B1 | * | 5/2002 | Clauss | 52/204.53 |
| 6,474,034 | B1 | * | 11/2002 | Dronigi | 52/473 |
| 6,474,038 | B2 | * | 11/2002 | Nien et al. | 52/717.01 |
| 6,505,669 | B2 | * | 1/2003 | Lilie et al. | 160/371 |
| 6,560,944 | B1 | * | 5/2003 | Wilson | 52/717.01 |
| 6,588,159 | B1 | * | 7/2003 | Cotton, Jr. | 52/211 |
| 6,745,523 | B2 | * | 6/2004 | Petta | 52/213 |
| 6,938,665 | B2 | * | 9/2005 | Lewis et al. | 160/96 |
| 8,024,899 | B2 | * | 9/2011 | Prince et al. | 52/211 |
| 8,453,397 | B2 | | 6/2013 | Prince et al. | |
| 2002/0121067 | A1 | * | 9/2002 | Nien et al. | 52/717.01 |
| 2003/0041539 | A1 | * | 3/2003 | Bernacki et al. | 52/204.54 |
| 2004/0003554 | A1 | * | 1/2004 | Beaudoin et al. | 52/204.54 |
| 2007/0125013 | A1 | * | 6/2007 | Prince | 52/204.1 |

* cited by examiner

METHODS AND SYSTEMS OF INTERIOR WINDOW FRAMING

RELATED APPLICATIONS

This is a continuation application of U.S. patent application Ser. No. 13/245,365 filed Sep. 26, 2011, entitled "METHODS AND SYSTEMS OF INTERIOR WINDOW FRAMING," which is a continuation application of U.S. patent application Ser. No. 11/138,225 filed May 26, 2005, entitled "METHODS AND SYSTEMS OF INTERIOR WINDOW FRAMING," now issued as U.S. Pat. No. 8,024,899, which claims priority to United States Provisional Patent Application Ser. No. 60/574,755, filed May 26, 2004, which are all expressly incorporated herein by reference in their entireties.

BACKGROUND OF THE INVENTION

1. Field of the Invention

The present invention relates to an interior window framing system, and more particularly to a decorative interior window framing system using fixed frames that are pre-assembled to correspond to standardized window dimensions.

2. Background Information

Building and home construction typically involves constructing several window openings to allow views of the outdoors, to allow natural light to enter, and to ventilate interior spaces. After a window is secured in place in such an opening, drywall is erected to surround the window and to cover any exposed electrical components or other hardware present in the supporting walls. It is very difficult, however, to cut drywall panels so that the edges of the window openings are perfectly straight and smooth and can meet to form a perfectly straight corner along the edges. Also, when drywall is cut, the edges of the drywall are left exposed. The exposed drywall core tends to crumble unless such edges are concealed and protected.

Drywall tape, comprising narrow strips of paper, may be used to protect drywall edges exposed at the cut edges. According to conventional methods, drywall tape is first applied to edges of abutting drywall and is then covered with wet plaster, commonly known as "mud." The plaster may then be feathered and smoothed along the edges of the tape to conceal the demarcations where the tape attaches to the drywall. When the wet plaster has dried, which often takes an entire day, the tape and drywall can be painted or otherwise covered with a wall covering.

A metal bead is another device commonly used to lend strength and durability to drywall corners. Conventional metal beads are configured in an L-shape comprised of elongated perforated strips of metal, such as galvanized steel. Such metal beads are typically positioned to extend along an outside corner within a room, such as the corner adjoining a window jamb and adjacent wall. The flanges of a metal bead are nailed into place through the drywall and into internal stud members located under the drywall. Wet plaster is then applied to cover the metal bead, and the edges of the plaster are smoothed and feathered in an attempt to conceal the juncture between the bead and the drywall.

The sheer number of such window finishing processes and the numerous people involved in performing such processes often result in non-uniform window openings having irregular edge/corner surfaces and dimensions. Further, such window openings are often out of square with the window pane, as the window finishing processes tend to obscure the relationship between the window opening and the window pane.

Traditional methods of providing and installing a decorative window frame to frame an interior window opening require customizing the decorative window frame, and often each element of the decorative window frame, to the resulting irregular window opening. As a result, framed window opening dimensions traditionally vary from window to window even within a single room. In addition, framed window openings traditionally tend to be out of square with the installed window. As a result of such inconsistencies, mass producing decorative window frames is often economically unfeasible, as such frames require considerable labor and expense to render them usable in connection with any particular window opening. Further, existing decorative window frames usually require modification to receive and support a standard window covering therein.

In short, despite the fact that windows are typically manufactured in standardized sizes, the process of constructing window openings typically results in the creation of window openings that are slightly off of the exact standardized dimensions, making it impossible to mass produce standardized interior window frames and standardized interior window coverings that do not need to be subsequently custom fit for each individual window opening.

SUMMARY OF THE INVENTION

The present invention provides an interior window framing system comprising a standardized frame having predetermined dimensions proportionate to a standard window.

As the present invention standardizes the dimensional characteristics of a framed window opening while facilitating squareness between a decorative window frame and a window, the window framing process is simplified and the costs associated with framing a window opening and installing a window covering are reduced accordingly.

An object of some embodiments of the present invention is to provide an interior window framing system that standardizes the dimensional relationship between a decorative window frame and a window, thereby standardizing the dimensions of a framed window opening.

Another object of some embodiments of the present invention is to provide an interior window framing system that facilitates squareness between a decorative window frame and a window.

Another object of some embodiments of the present invention is to provide a window framing system capable of easy implementation by those with a minimum of carpentry knowledge and experience.

A further object of some embodiments of the present invention is to provide an interior window framing system that minimizes costs when the framing system is mass produced.

Another object of some embodiments of the present invention is to provide an interior window framing system capable of easily and predictably receiving and supporting a standardized window covering.

These and other features and advantages of embodiments of the present invention will be set forth or will become more fully apparent in the description that follows. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

The present invention may be embodied in forms besides the specific embodiments presented here without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

As used in this specification, the term "window pane" refers to a standard window pane capable of being installed and retained within a window opening. The term "window opening" refers to a variably dimensioned finished opening resulting within a supporting wall after completion of associated window finishing procedures. The term "window covering" refers to any shutter, blind, shade or other window covering capable of being retained within a window opening. The term "window jamb" refers to a supporting wall structure adjoining an outer edge of the window opening, the surface of the jamb typically being perpendicular to the surface of the window pane. The term "adjacent wall" indicates a supporting wall structure adjoining the window jamb.

The terms "mounting hardware" and "hardware" refer to any hardware or combination of hardware capable of retaining the interior window framing system of the present invention within a window opening, including, but not limited to, screws, bolts, rivets, nails, staples, adhesives and cement. The term "drywall" refers to a rigid structure for finishing a wall comprising approximately a one half-inch layer of plaster or gypsum sandwiched between two sheets of paper. The term "finishing a window" or "window finishing procedures" refers to the processes of securing a window within a window opening and caulking and taping the surrounding drywall at the edges to achieve a smooth finish.

Figure 1:
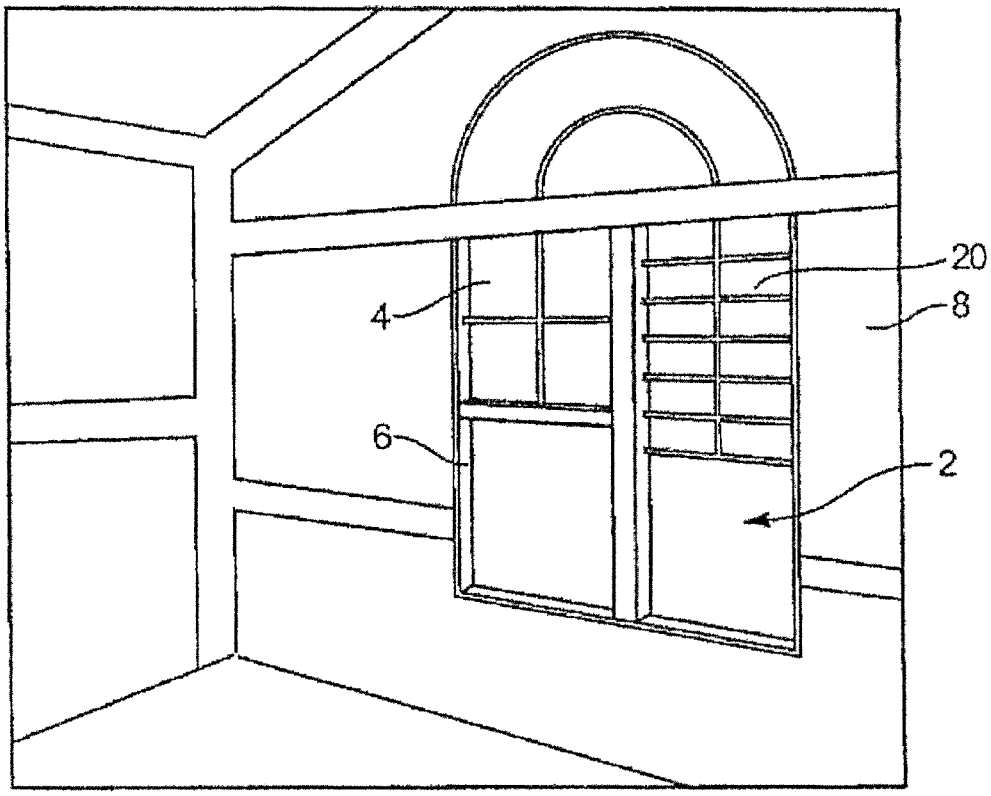
FIG. 1 is a perspective view of a window opening and its associated components configured to receive an interior window framing system in accordance with some embodiments of the present invention.

Referring now to FIG. 1, an interior window pane 4 may be mounted within a window opening 2 bordered by a window jamb 6 and an adjacent wall 8. As will be explained, an optional window covering 20 may be incorporated into the present invention as well. Upon initial construction, drywall is typically erected to surround window openings 2 to create supporting structures and to cover exposed electrical components and other hardware. As drywall is inherently unstable as well as unsightly at its exposed edges, traditional methods of framing a window opening require that an exposed drywall edge be finished by caulking and/or taping the drywall, particularly at the edges or corner joint located where the window jamb 6 and the adjacent wall 8 meet.

The resulting finished edge may create a window opening 2 having dimensions substantially different from those originally contemplated. Indeed, the number of processes required to finish the edges/corner joints and the numerous people involved in carrying out such processes inevitably results in a certain degree of dimensional as well as characteristic variation along the finished edges.

Figure 2A:
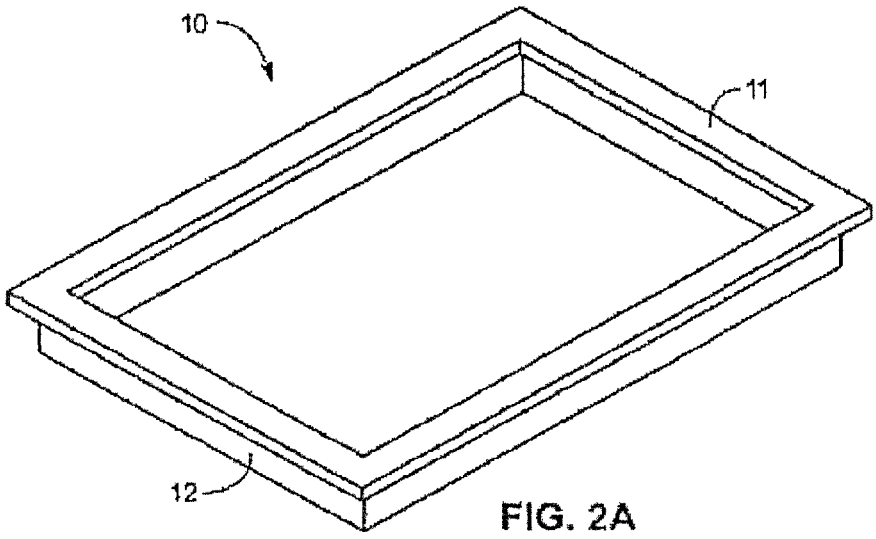
FIG. 2A is a perspective view of a decorative standardized window frame in accordance with some embodiments of the present invention.

FIG. 2A is a perspective view of a decorative standardized window frame 10 having a frame face 11 and a frame support 12. In some embodiments of the frame 10, the frame face 11 and frame support 12 may comprise one unitary and integrally formed part; in other embodiments, the frame face 11 and frame support 12 comprise separate parts that are designed to be coupled together. As shown in FIG. 1, frame 10 preferably comprises four sides and four corners; however the present invention contemplates other numbers of sides and corners, such as three sides with two corners, as well as other shapes to correspond to windows having various shapes. Frame 10 is preferably created to have dimensions slightly smaller than a window opening 2 of a standard dimension.

Figure 2B:
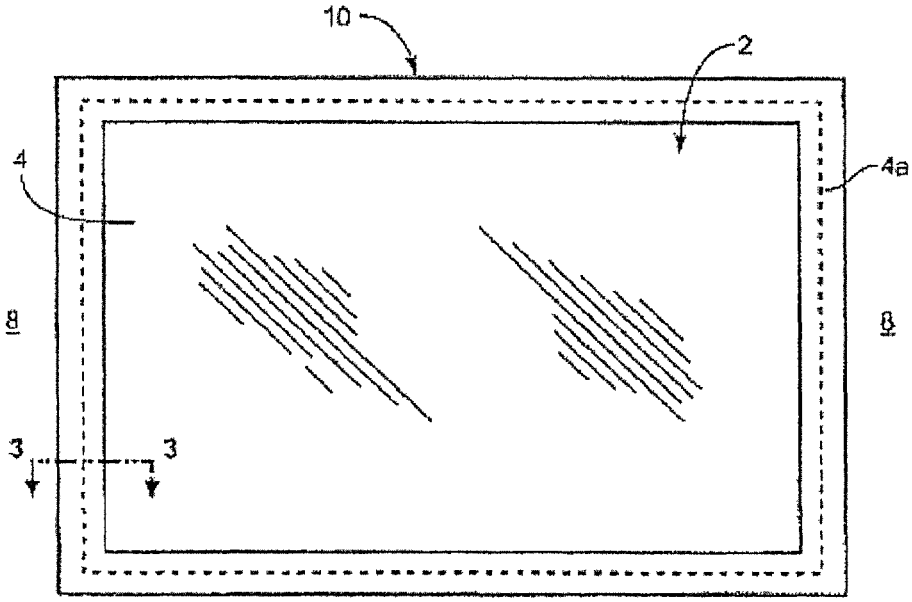
FIG. 2B is a plan view of a standardized window frame installed in accordance with certain embodiments of the present invention.

FIG. 2B is a plan elevational view of FIG. 2A and depicts a standardized window frame 10, viewed from the interior of a room and installed adjacent a finished window opening 2 in accordance with certain embodiments of the present invention. As seen in FIG. 2, a standard window pane 4 spans a greater area than that of its associated window opening 2, such that the window pane 4 can be supported and retained therein (edges 4*a* of the window pane 4 are depicted by dashed lines). As discussed earlier, a finished edge 9 of the window opening 2 typically comprises irregular dimensions that are often out of square with the window pane 4 because the window opening 2 is shaped by a finished edge 9. The standardized window frame 10 of the present invention overcomes this problem by having predetermined, standardized, fixed dimensions proportionate to the shape of the standardized window pane 4. The fixed dimensions of the frame 10 ensure that it will be proportionate to the standardized window dimensions rather than to the variable dimensions of the window opening 2. Similarly, as will be evident from this Discussion and accompanying drawings, the standardized window frame 10 of the present invention does not require direct contact with the window jamb 6; thus, the frame 10 may be selectively leveled and squared with the window pane 4 rather than with the window opening 2. In this manner, the present invention standardizes the relationship between the window pane 4 and a decorative window frame 10.

Figure 3:
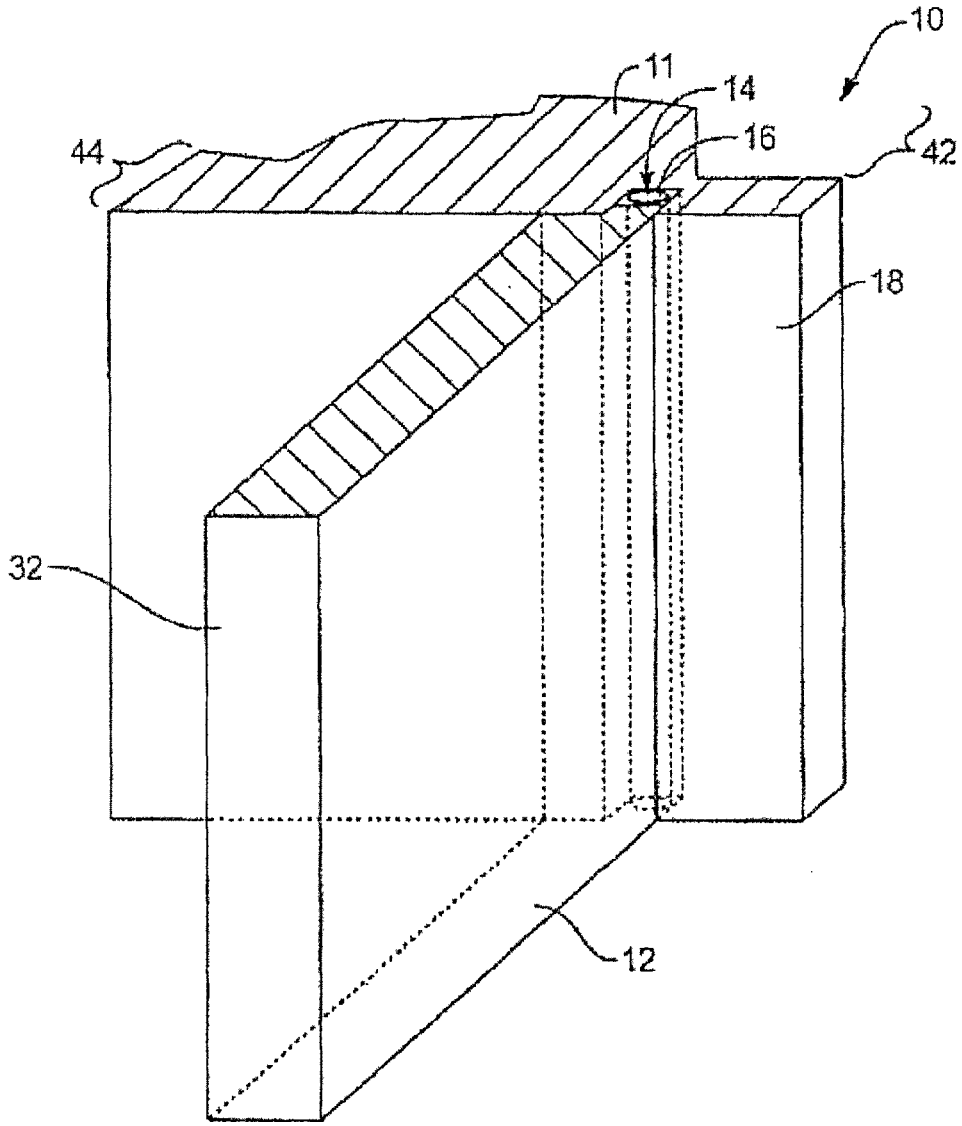
FIG. 3 is a perspective sectional view, taken along line 3-3 in FIG. 2B, of a section of the decorative window framing element in accordance with certain embodiments of the present invention.

FIG. 3 depicts a perspective sectional view of one embodiment of the window frame 10, the sectional view being taken from line 3-3 in FIG. 2. As was mentioned earlier, in some embodiments of the present invention, the frame face 11 and frame support 12 together comprise a unitary structure. Alternatively, the standardized window frame 10 may comprise a multi-component structure having distinct elements corresponding to the frame face 11 and the frame support 12. The standardized window frame 10 may comprise wood, wood composite, plastic, fiberglass, metal or any other substantially rigid material known to those in the art. Preferably, the standardized window frame 10 comprises properties of elasticity and strength sufficient to support the weight and bulk of a window covering 20 installed thereon.

Figure 8:
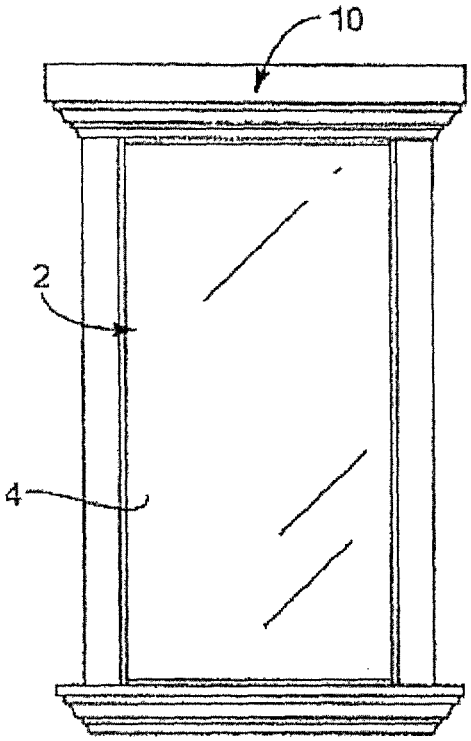
FIGS. 8-21B show various aspects of embodiments of the present invention.
Figure 9:
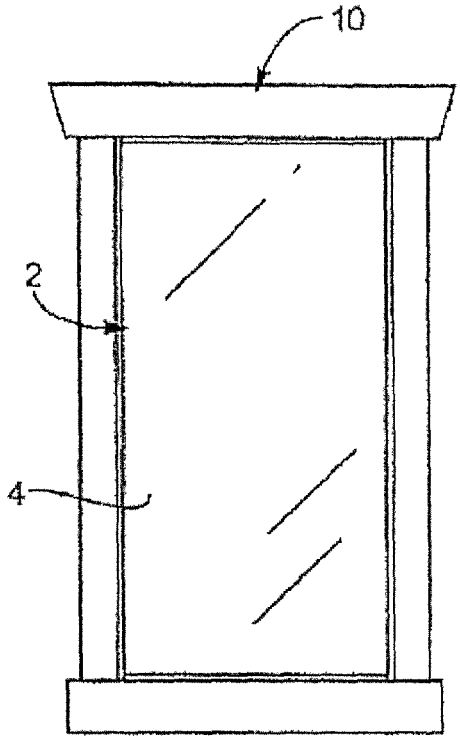
Figure 10:
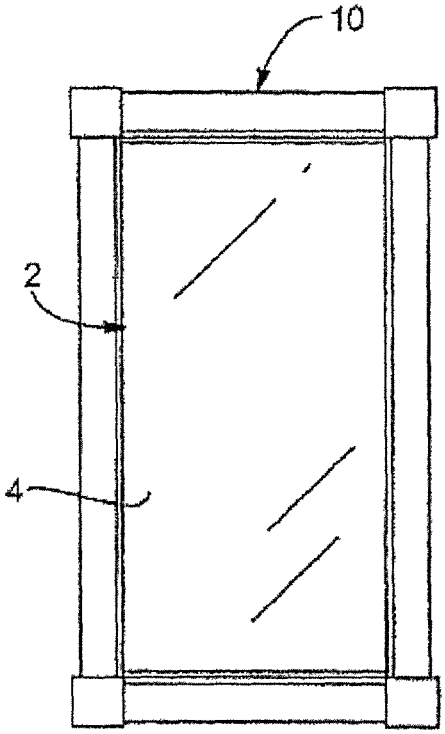

The frame face 11 has a top surface which, in some embodiments, comprises decorative features 80 (see, for example, FIGS. 14 and 15) such as ridges, curves and/or grooves integrated at various depths therein. The frame face 11 may be positioned substantially adjacent an adjacent wall 8 proximate a window opening 2 such that the frame face 11 effectively frames the window opening 2. (FIGS. 8 through 10 show some examples of standardized window frames 10 framing window openings 2.) The depth of the frame face 11 may taper from the first decorative feature to the outer edge of the frame face 11 such that an outer perimeter 44 of the frame face 11 is substantially shallower in depth than an inner perimeter 42 of the frame face 11.

Embodiments of the frame face 11 of the present invention may be secured to an adjacent wall 8 by mounting hardware, or by any other means known to those skilled in the art. In some embodiments, an industrial screw or other suitable mounting hardware 28 is driven through the frame face 11 into the adjacent wall 8, and further into an internal stud member. This securing technique ensures proper attachment and reliability of the window framing system over time. Similarly, it is also preferred to secure the frame face 11 at relatively small intervals along a window opening 2 to provide additional support for the interior window framing system of the present invention, as well as for any window covering 20 that may be attached thereto, as discussed further herein.

Figure 4:
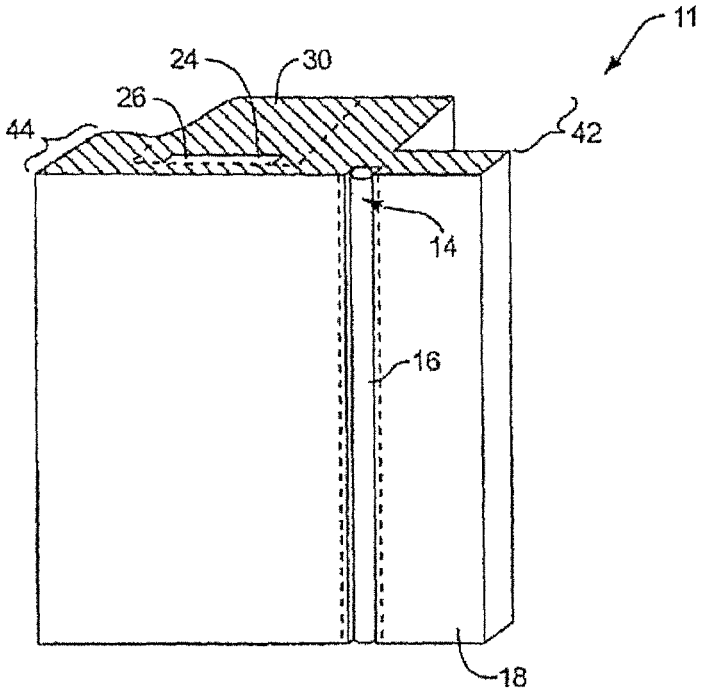
FIG. 4 is a perspective view of a frame face of the decorative window framing element.
Figure 17:
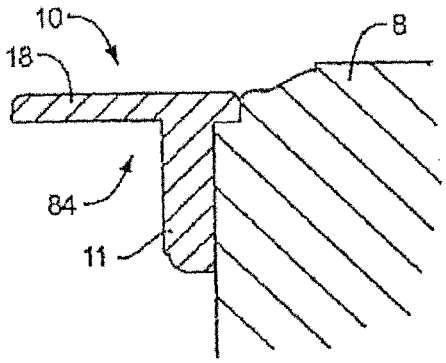
Figure 18:
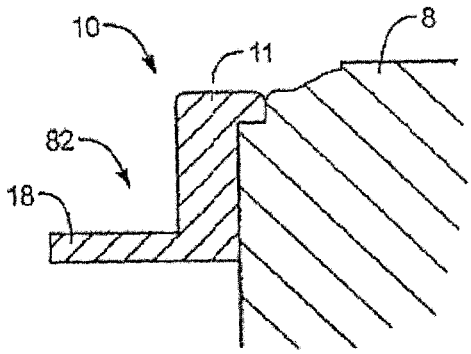

As seen in FIGS. 3 and 4, a frame face 11 may optionally incorporate a flange 18 at its inner perimeter 42 to facilitate installation and retention of a window covering 20. A flange 18 may comprise a "T" configuration (see FIG. 17), an "S" configuration or a "Z" configuration (see FIG. 18) with respect to the frame face 11, depending on the ultimate purpose for which the flange 18 is intended (for example, the "T" configuration is suitable to receive blinds or plantation blinds; the "S" or "Z" is suitable to receive shutters). Where a frame face 11 is properly secured to an adjacent wall 8 as discussed above, the flange 18 may extend beyond the window opening 2 such that a portion of the window 4 is obscured by the flange 18. In this manner, the flange 18 may create a mounting surface for mounting and retaining a window covering 20, such as a shutter, blind or shade. In addition, the flange 18 may block incoming sunlight around the perimeter of window coverings 20 that do not completely occupy a window opening 2, such as a blind or shade.

Referring now to FIG. 4, a frame face 11 may further incorporate a mounting channel 24 that is preferably substantially centered with respect to the inner perimeter 42 and the outer perimeter 44 of the frame face 11. Alternatively, one or more mounting channels 24 may be incorporated into one or more sides of the frame face 11. A mounting channel 24 may include a plurality of mounting points 26 for inserting a fastener 28 or other mounting hardware. A mounting channel 24 facilitates installation of the interior window framing system of the present invention as any fasteners 28 or other mounting hardware used to secure the window framing system in place may be directly implemented through the top surface of the frame face 11. A frame face 11 may further incorporate a concealing strip 30 capable of being inserted into and retained by the mounting channel 24. For example, the mounting channel 24 may incorporate laterally disposed protrusions to retain an edge of the concealing strip 30. The concealing strip 30 may include decorative features commensurate with the decorative features of the frame face 11 such that, upon insertion of the concealing strip 30, the fasteners 28 or other hardware used to mount the frame face 11 are effectively concealed without interrupting the aesthetic qualities of the frame face 11. In this manner, even a layperson with minimal carpentry knowledge or experience may install the window framing system of the present invention without risk of compromising its aesthetic integrity.

Referring again to both FIGS. 3 and 4, where a standardized window frame 10 built according to one embodiment of the present invention comprises at least two independent components, the frame face 11 may incorporate a groove or recess 14 longitudinally disposed along its bottom surface. The groove or recess 14 may substantially correspond to the first decorative feature proximate the window opening 2, such that the recess 14 may be accessed immediately beyond the adjacent wall 8. The recess 14 may comprise a depth sufficient to retain a complementary flange of a frame support 12. The recess 14 may further comprise a resilient finger 16 coupled to or retained within the recess 14. A resilient finger 16 may comprise foam rubber, plastic, or any other resilient material known to those in the art. In addition, a resilient finger 16 may comprise a unitary strip or segmented material interspersed within the recess 14. The resilient finger 16 may enable a snug fit between the frame face 11 and the frame support 12 despite variances in the depth of the pertinent window jamb 6. In addition, the resilient finger 16 may allow a standard size frame support 12 to be used in connection with a window jamb 6 having slightly substandard dimensions overall, as the resilient finger 16 may be manipulated to accommodate the window jamb 6, or may be removed in its entirety.

Figure 5:
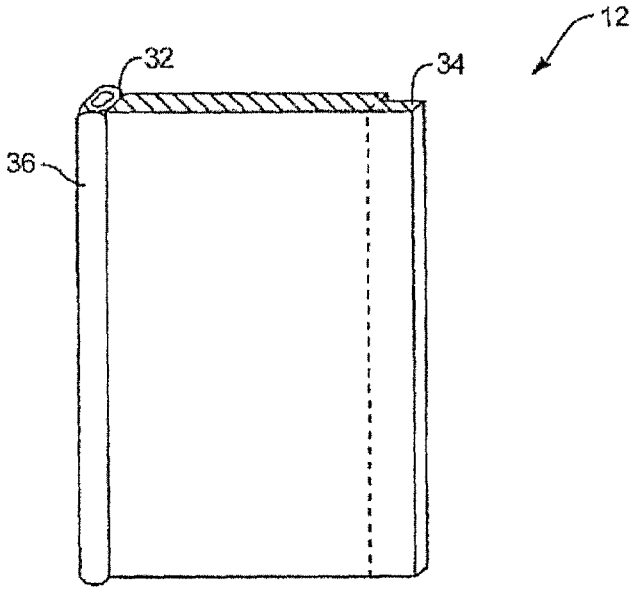
FIG. 5 is a perspective view of a frame support of the decorative window framing element.

Referring now to FIG. 5, a frame support 12 may comprise a substantially uniform plate having at least one laterally disposed rabbeted edge 34. A frame support 12 may comprise wood, composite, plastic, fiberglass, metal or any other rigid material known to those in the art. Preferably, a frame support 12 comprises properties of elasticity and strength sufficient to support the weight and bulk of a window covering installed thereon. In selected embodiments, a frame support 12 comprises the same material as its associated frame face 11 to enhance the overall aesthetic appearance of the standardized window frame 10.

A frame support 12 may further comprise bridging means 36 coupled to an edge 32 opposite its rabbeted edge 34 such that the bridging means 36 bridges a space between the frame support 12 and the surface of the window pane 4. Further, the bridging means 36 may protect the surface of the window pane 4 from direct interface with the frame support 12. The bridging means 36 may also facilitate more friction, and hence more stable contact, between the frame support 12 and the surface of the window pane 4. Bridging means 36 may comprise foam rubber, plastic, wood, composite, or any other material known to those in the art capable of bridging a junction between the frame support 12 and the window surface 4. Bridging means 36 may further comprise a unitary strip or, alternatively, segments of an appropriate material intermittently placed to cushion and/or otherwise bridge the juncture between the frame support 12 and the window surface 4.

Where a frame support 12 and a frame face 11 are elements of a unitary structure, the frame support 12 extends in a direction normal to and opposite from the top surface of the frame face 11, such that the frame support 12 is preferably substantially hidden from view when viewing the exposed surface of the frame face 11 directly. Where the frame support 12 and the frame face 11 are individual elements of a composite structure, as shown as separate and individual elements in FIGS. 4 and 5, the rabbeted edge 34 of the frame support 12 may engage the recess 14 longitudinally disposed along the frame face 11 such that the frame support 12 is retained at an angle substantially normal to and away from the top surface of the frame face 11, similar to the unitary structure discussed previously. Alternatively, the standardized window frame 10 may comprise a multi-component structure.

In any case, the combined frame face 11 and frame support 12 create the appearance of a uniform window casing spanning the window jamb 6 and a portion of the adjacent wall 8 to frame a window opening 2. As the implementation of a window framing system in accordance with the present invention completely cases the edge common to a window jamb 6 and adjacent wall 8, corner finishing procedures to smooth the juncture between the drywall and a window opening 2 are largely unnecessary. A window framing system in accordance with the present invention thus reduces, and may eliminate, much of the labor and expense associated with framing and finishing a window.

As discussed above with reference to FIG. 3, a frame face 11 may include a resilient finger 16 coupled to or retained within the recess 14 longitudinally disposed thereon. Upon engaging the rabbeted edge 34 of the frame support 12 with the recess 14, the resilient finger 16 may remain fully expanded to occupy a space between the rabbeted edge 34 and the boundary of the recess 14, or may be manipulated or removed to enable a closer connection between the rabbeted edge 34 and the frame face 11. In this manner, the relationship between the frame support 12 and the frame face 11 may be manipulated to ensure a snug fit between the portions 11 and 12 and to enable use of a standard size frame support 12 in connection with window jambs 6 of substandard or irregular dimensions.

Figure 6:
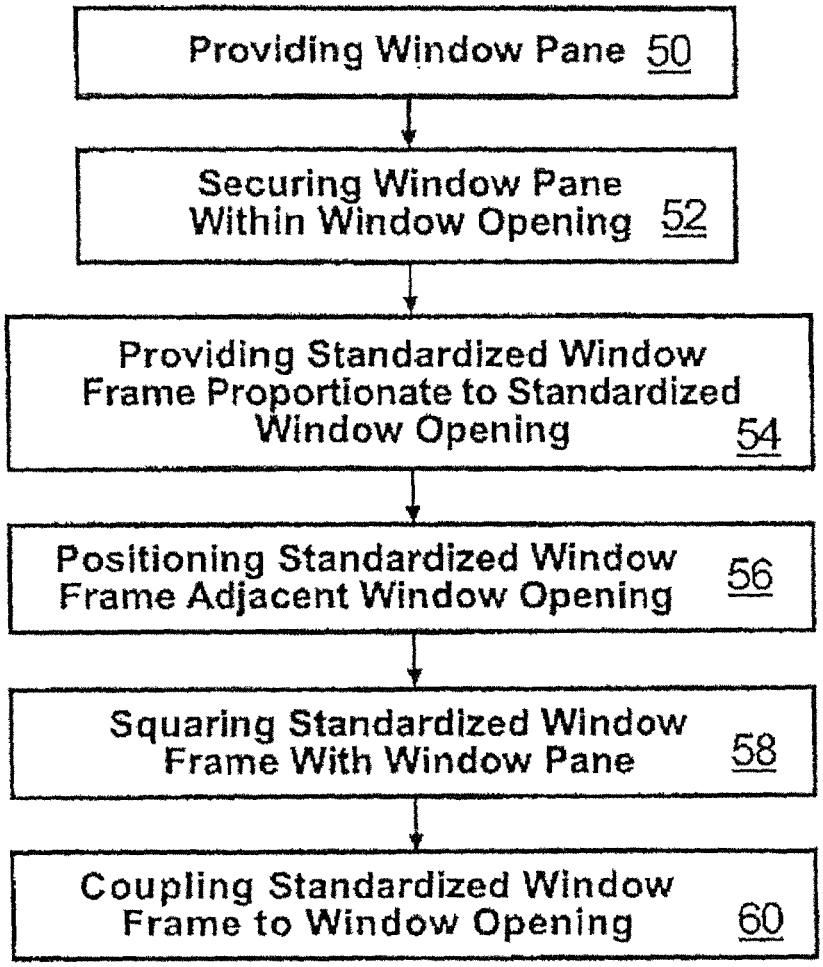
FIG. 6 is a flow chart outlining steps for framing an interior window in accordance with certain embodiments of the present invention.

Referring now to FIG. 6, certain embodiments of the methods of the present invention comprise first providing a window pane 50 having standard or substantially standard dimensions. Since standard window dimensions provide the basis for determining the dimensions of a standardized window framing 10 in accordance with the present invention, this first step is important to the present methods. A second step in accordance with the present methods may comprise securing the window pane within an unfinished window opening 52. The process of securing a window pane within a window opening is well known in the art.

A third step in accordance with the present invention comprises providing a decorative, standardized window frame having dimensions proportionate to the dimensions of the window 54. The standardized window frame may then be positioned substantially adjacent the window opening 56 in a fourth step.

A fifth optional step comprises squaring the standardized window frame with the window pane 58. This step will be most useful where the window pane is properly installed and level. A sixth and final step may comprise coupling the standardized window frame to the window opening 60. As discussed earlier, this step may be accomplished by any means known to those in the art. In most cases, the frame face 11 of the standardized window frame will be coupled to an adjacent wall 8 by mounting hardware or other means known to those in the art.

Figure 7:
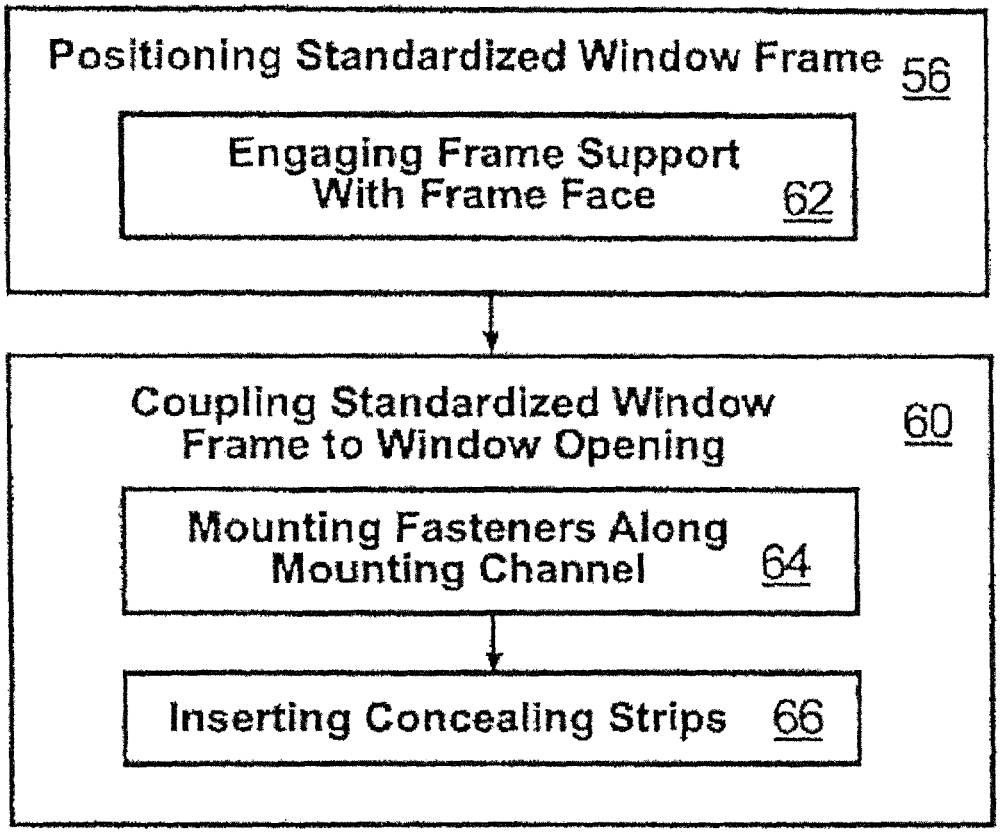
FIG. 7 is a flow chart outlining further steps for positioning and securing a decorative window frame.

Referring now to FIG. 7, certain embodiments of the present invention provide that positioning the standardized window frame adjacent the window opening 56 may further comprise inserting 62 an edge of the frame support 12 of a standardized window frame 10 into a recess disposed along the frame face 11. Coupling a standardized window frame to the window opening 60 may further comprise mounting 64 fasteners along a mounting channel disposed along the frame face 11 to secure the combined standardized window frame structure to an adjacent wall 8. Finally, coupling a standardized window frame to the window opening may comprise inserting 66 a concealing strip into the mounting channel such that the concealing strip is thereby retained and the fasteners thereby concealed.

Figure 11:
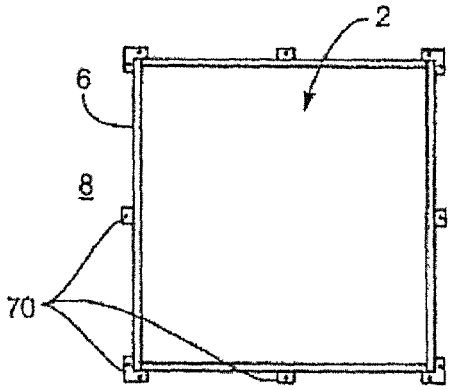
Figure 12:
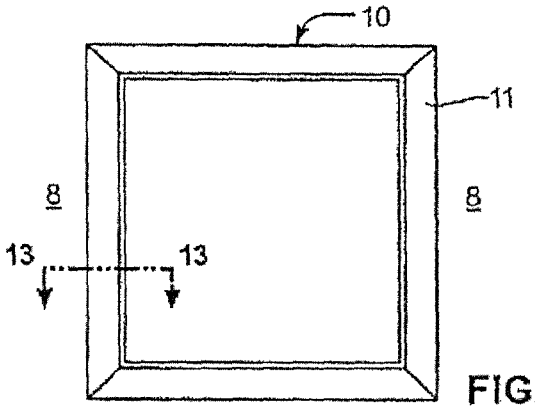
Figure 13:
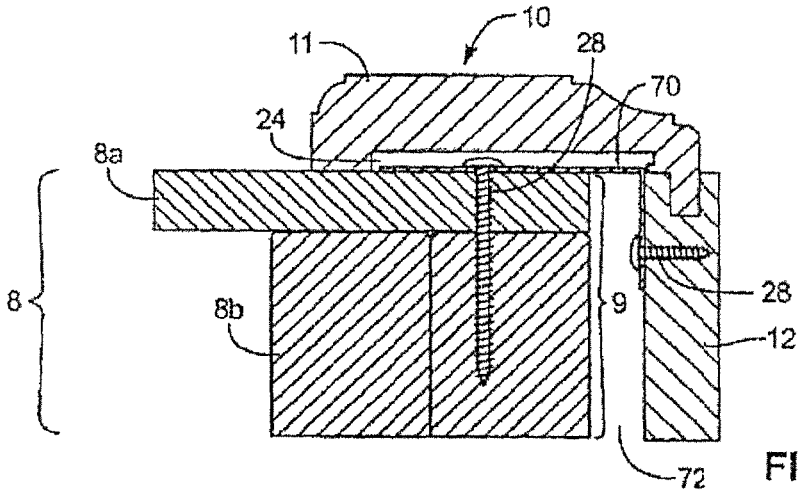
Figure 14A:
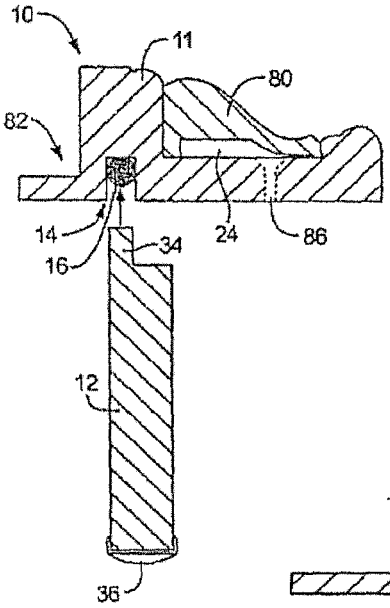
Figure 14B:
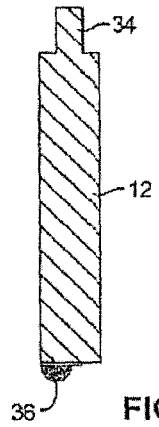
Figure 15:
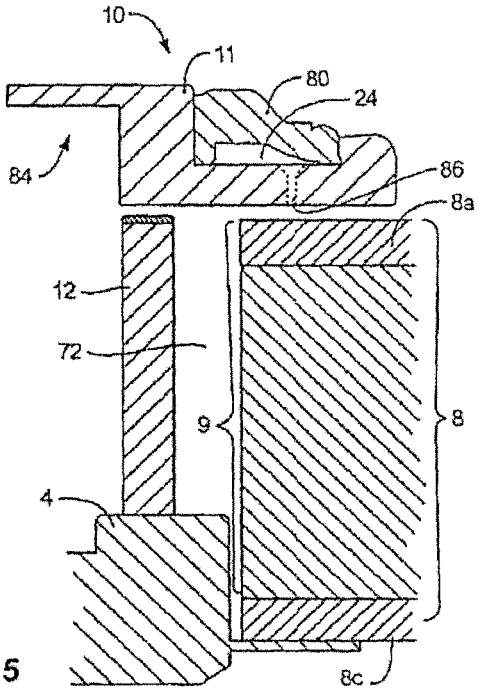
Figure 16:
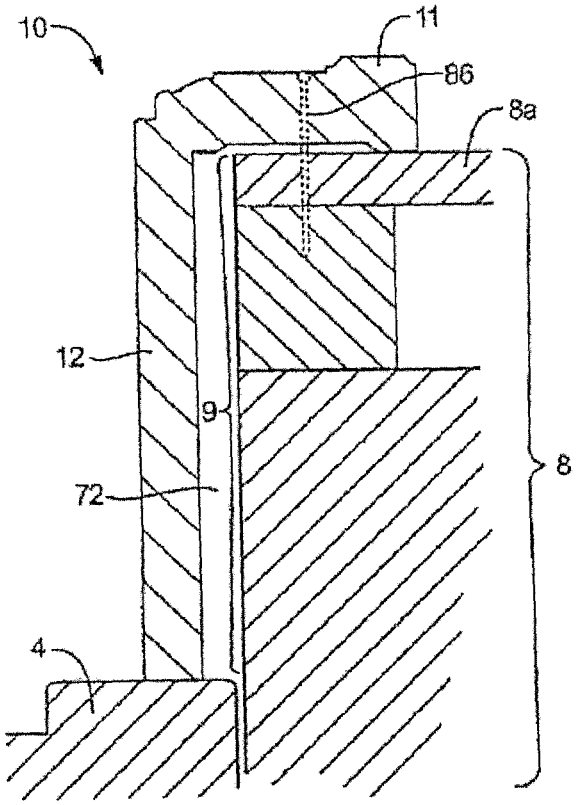
Figure 19:
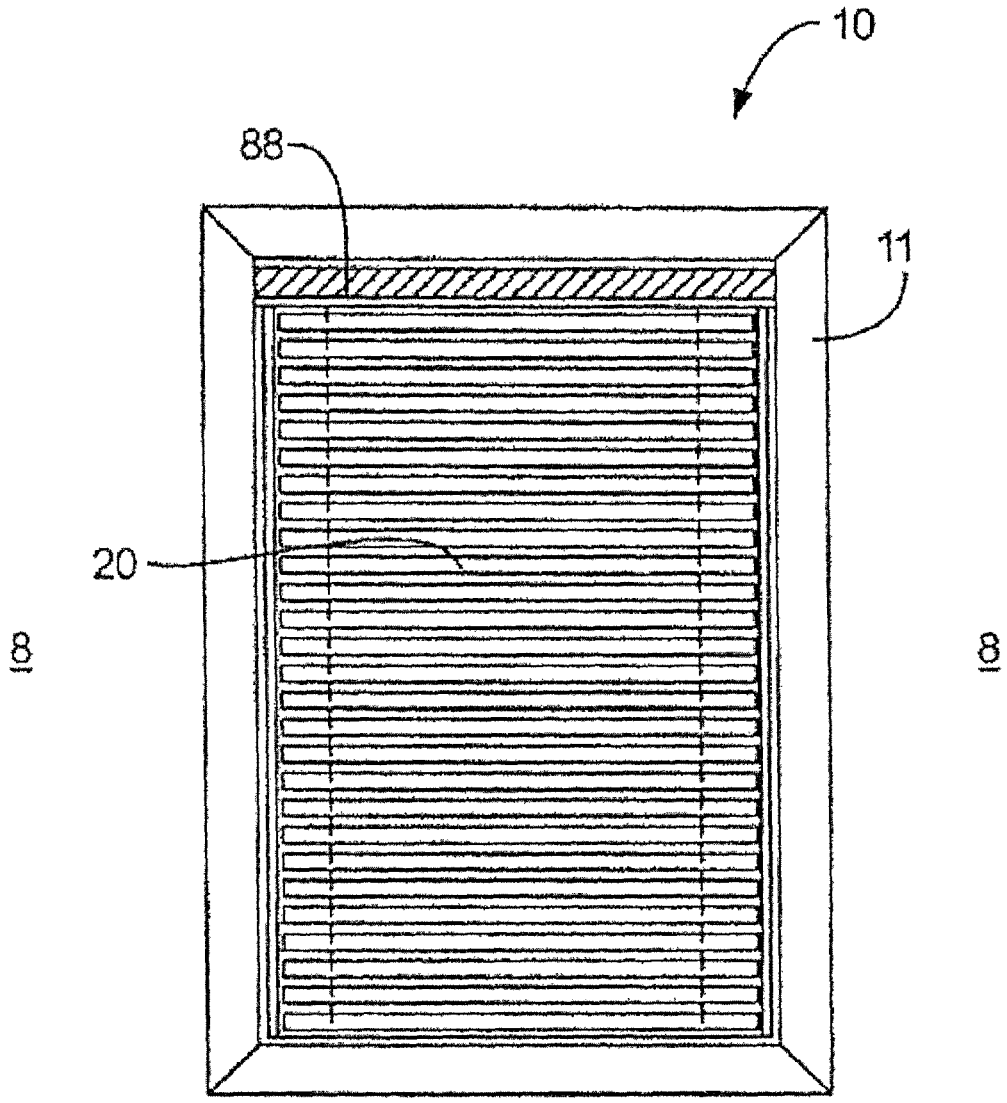
Figure 20:
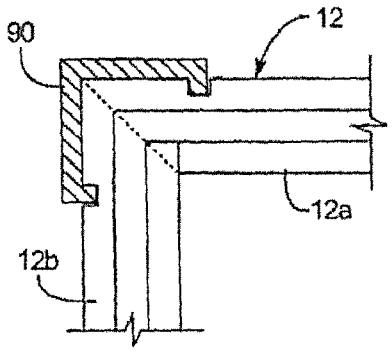
Figure 21A:
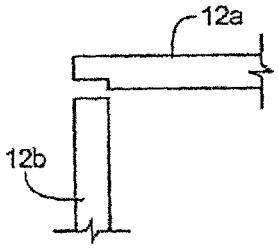
Figure 21B:
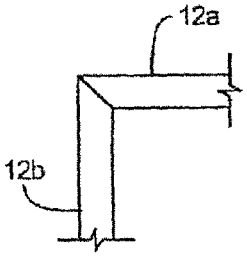

The remaining Figures show various aspects of embodiments of the present invention. FIG. 11 shows a frame support 12 coupled to brackets or metal clips 70. FIG. 13 shows a top view of a cross section taken along line 13-13 in FIG. 12. Note the space 72. FIG. 14A shows a cross section like FIG. 13. Hole 86 shows where screws 28 or the like can be seated to couple the frame 10 to the wall 8. Element 8*c* in FIG. 15 shows the exterior portion of the wall that faces the outside of the house or room. FIG. 16 shows unitary frame 10 wherein the frame support 12 and frame face 11 are unitary and not individual elements. FIG. 19 shows a window covering 20 having a valance 88 coupled to the top of the frame 10. FIGS. 20 through 21B show a section of a corner of a frame support 12 comprising sides 12*a* and 12*b* that can be cut to come together in a variety of ways. Sides 12*a* and 12*b* are put together by a corner 90 made of flexible metal or the like. The metal is a strip that bends into the corner 20 to hold sides 12*a* and 12*b* together.

Note that the present invention can be embodied in a variety of ways. For example, elements 14 and 34 can be a tongue and groove interconnection—regardless of whether the tongue portion is located on element 11 or on element 12.

What is claimed is:

1. An apparatus configured to frame a window having a window opening, a window pane, a window jamb, and an adjacent wall surrounding the window opening, said apparatus comprising:

a decorative molding having:

a decorative strip portion comprising a unitary frame face configured to extend over a portion of the adjacent wall and provide a frame around said window opening, and a discrete and unitary frame support portion configured to extend into said window opening and surround an interior portion of said window jamb, wherein the decorative strip portion and the unitary frame support portion are configured to couple with each other via a connection in which a protrusion is received within a recess such that the unitary frame support portion extends substantially perpendicularly from a back side of said decorative strip portion and such that said decorative strip portion and said unitary frame support portion are configured to be adjustably coupleable with each other to adjust for variations in depth of the window jamb.

2. The apparatus of claim 1, wherein the unitary frame support portion comprises at least two sections that are joined with a corner bracket.

3. The apparatus of claim 1, wherein the frame support portion comprises:

a first portion configured to cover a portion of a head of the window jamb;

a second portion configured to cover a portion of a sill of the window jamb;

a third portion configured to cover a portion of a first vertical jamb of the window jamb; and a fourth portion configured to cover a portion of a second vertical jamb of the window jamb.

4. The apparatus of claim 1, wherein the unitary frame support portion comprises a proximal end, which couples with the unitary frame face, and a distal end, which is substantially opposite to the proximal end, wherein the decorative molding further comprises a resilient member, and wherein the resilient member is disposed in a location selected from (i) the distal end of the unitary frame support portion and (ii) a joint between the unitary frame support portion and the unitary frame face.

5. The apparatus of claim 4, wherein the resilient member is disposed at the distal end of the unitary frame support portion.

6. The apparatus of claim 1, wherein the unitary frame support portion comprises an outer perimeter having a predetermined and standardized size.

7. The apparatus of claim 1, wherein the unitary frame support portion comprises a proximal end, which couples with the unitary frame face, and a distal end, which is substantially opposite to the proximal end, wherein the distal end of the unitary frame support is configured to terminate proximal to the window pane when the window pane is fixed in the window opening, when the unitary frame support is coupled to the window opening and when the back side abuts a surface of the adjacent wall.

8. The apparatus of claim 1, wherein the unitary frame support portion comprises a proximal end, which couples with the unitary frame face, and a distal end, which is substantially opposite to the proximal end, and wherein the decorative molding further comprises a bracket that is attached to the unitary frame support so as to run substantially perpendicular to a length of the unitary frame support running between the proximal end and the distal end of the unitary frame support, and wherein the bracket is configured to abut and be attached to the adjacent wall, between the adjacent wall and the back side of the decorative strip portion.

9. An apparatus configured to frame a window having a window opening, a window pane, a window jamb, and an adjacent wall surrounding the window opening, the apparatus comprising:

a decorative molding having:

a unitary frame face configured to extend over a portion of the adjacent wall and provide a continuous frame around the window opening, and a discrete and unitary frame support portion configured to extend into the window opening and surround an interior portion of the window jamb, wherein the unitary frame face and the unitary frame support portion are configured to couple with each other via a connection in which a protrusion is received within a recess such that the unitary frame support portion extends substantially perpendicularly from a back side of the unitary frame face and such that the unitary frame face and the unitary frame support portion are configured to be adjustably coupleable with each other to adjust the decorative molding for variations in depth of the window jamb, and wherein the decorative molding is configured to be squared in the window opening, independent of the window pane.

10. The apparatus of claim 9, wherein the unitary frame support portion comprises at least two sections that are joined with a corner bracket.

11. The apparatus of claim 9, wherein the unitary frame support portion comprises a proximal end, which couples with the unitary frame face, and a distal end, which is substantially opposite to the proximal end, wherein the decorative molding further comprises a resilient member, and wherein the resilient member is disposed in a location selected from (i) the distal end of the unitary frame support portion and (ii) a joint between the unitary frame support portion and the unitary frame face.

12. The apparatus of claim 9, wherein the unitary frame support portion comprises a proximal end, which couples with the unitary frame face, and a distal end, which is substantially opposite to the proximal end, wherein the distal end of the unitary frame support is configured to terminate proximal to the window pane when the window pane is fixed in the window opening, when the unitary frame support portion is coupled to the window opening, and when the back side abuts a surface of the adjacent wall.

13. The apparatus of claim 9, wherein the unitary frame support portion comprises a proximal end, which couples with the unitary frame face, and a distal end, which is substantially opposite to the proximal end, and wherein the decorative molding further comprises a bracket that is attached to the unitary frame support portion so as to run substantially perpendicular to a length of the unitary frame support portion running between the proximal end and the distal end of the unitary frame support portion, wherein the bracket is configured to abut and be attached to the adjacent wall, between the adjacent wall and the back side of the unitary frame face.

14. The apparatus of claim 9, wherein the unitary frame support portion comprises a flange that is configured to extend into the window opening, substantially perpendicular to a length of the unitary frame support running between a proximal end and a distal end of the unitary frame support portion.

15. An apparatus configured to frame a window having a window opening, a window pane, a window jamb, and an adjacent wall surrounding the window opening, the apparatus comprising:

a unitary frame face configured to extend over a portion of the adjacent wall and provide a continuous frame around the window opening, and a discrete and unitary frame support portion configured to extend into the window opening and surround an interior portion of the window jamb, wherein the unitary frame support comprises a distal end and a proximal end, wherein the proximal end of the unitary frame support is configured to adjustably couple with a back side of the unitary frame face to adjust for variances in a depth of the window jamb, and wherein the distal end of the unitary frame support is configured to terminate proximal to the window pane when the window pane is fixed at the window opening, when the unitary frame support portion is coupled to the window opening, and when a back side of the unitary frame face abuts a surface of the adjacent wall.

16. The apparatus of claim 15, wherein the unitary frame face and the unitary frame support portion are configured to be squared in the window opening, independent of the window pane.

17. The apparatus of claim 15, wherein the unitary frame support portion comprises at least two sections that are joined together with a corner bracket.

18. The apparatus of claim 15, further comprising a resilient member, and wherein the resilient member is disposed in a location selected from: (i) the distal end of the unitary frame support portion and (ii) a joint between the unitary frame support portion and the unitary frame face.

19. The apparatus of claim 18, wherein the resilient member is disposed at the joint between the unitary frame support portion and the unitary frame face.

20. The apparatus of claim 15, further comprising a bracket that is attached to the unitary frame support portion so as to run substantially perpendicular to a length of the unitary frame support portion running between the proximal end and the distal end of the unitary frame support portion, wherein the bracket is configured to abut and be attached to the adjacent wall, between the adjacent wall surface and the back side of the unitary frame face.

* * * * *